US006398030B1

(12) United States Patent
Smith et al.

(10) Patent No.: US 6,398,030 B1
(45) Date of Patent: Jun. 4, 2002

(54) BAG DISPENSER

(75) Inventors: Dennis Ray Smith, Laurel, MD (US); Charles Arthur Weiss, Jr., Clinton; Philip Garcin Malone, Vicksburg, both of MS (US)

(73) Assignee: The United States of America Army Corps of Engineers as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/628,940

(22) Filed: Jul. 28, 2000

(51) Int. Cl.[7] ..... B65D 1/34
(52) U.S. Cl. ..... 206/554; 206/383; 383/37
(58) Field of Search ..... 206/554, 383, 206/804, 820; 383/37

(56) References Cited

U.S. PATENT DOCUMENTS

| | | | | | |
|---|---|---|---|---|---|
| 2,120,204 | A | * | 6/1938 | Langhorst | 239/54 |
| 4,658,962 | A | * | 4/1987 | Burns et al. | 206/554 |
| 4,674,634 | A | * | 6/1987 | Wilson | 206/554 |
| 4,978,231 | A | * | 12/1990 | Ling et al. | 383/11 |
| 4,989,732 | A | | 2/1991 | Smith | |
| 4,989,994 | A | * | 2/1991 | Gelbard | 383/37 |
| 5,007,744 | A | * | 4/1991 | Scarberry et al. | 383/37 |
| 5,183,158 | A | | 2/1993 | Boyd | |
| 5,363,965 | A | | 11/1994 | Nguyen | |
| 5,671,847 | A | * | 9/1997 | Pedersen et al. | 206/554 |
| 5,738,893 | A | * | 4/1998 | Kornet et al. | 426/413 |
| 5,863,130 | A | | 1/1999 | Nguyen | |

* cited by examiner

*Primary Examiner*—Mickey Yu
*Assistant Examiner*—Troy Arnold
(74) *Attorney, Agent, or Firm*—John MacEvoy

(57) ABSTRACT

Plastic, paper, aluminum foil, or aluminum foil laminated with plastic bags are dispensed, one at a time, from a bag dispenser. In a first embodiment, bags are provided in rolls, connected top-to-top and bottom-to-bottom. Each bag is tapered towards its bottom such that its top-to-top connection with the next bag is wider than the bottom-to-bottom connection. Each bottom-to-bottom connection has sealed seams, which ensure that the bags are closed at their bottoms, and a row of closely spaced perforations on a connecting portion between two seams, which allow adjacent bags to be separated by pulling and tearing along the row of perforations.

Figure 1:
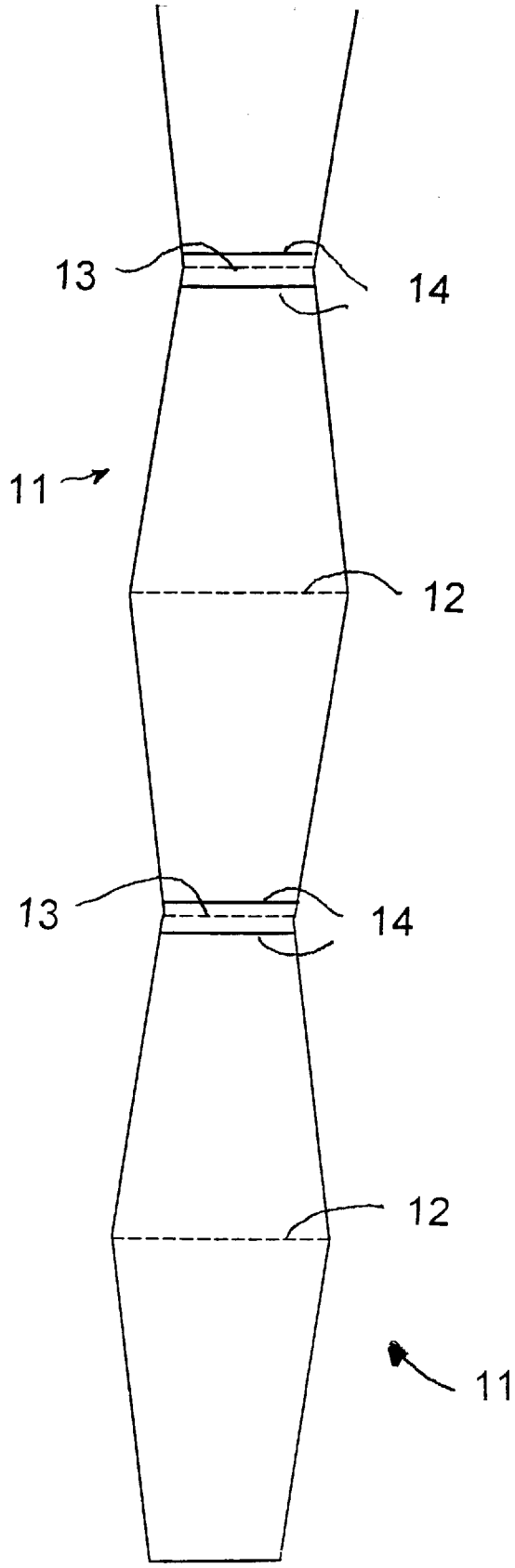

In an alternate embodiment of this invention, a plurality of tapered bags is nested with one bag inside the next adjacent bag. The bags are tapered at both sides such that their bottoms are narrower than their tops. At their tops, they are attached to strips of materials that are in turn attached to each other by conventional means such as staples. Rows of closely spaced perforations ensure that each bag is open when a bag is separated from the strips by pulling and tearing along the row of perforations.

In a third embodiment the bags are nested and attached to a perforated central tab that passes through the bottom seam of each bag. The nested arrays of bags may be placed in a funnel-like dispenser that holds the nested bags in an upright position.

3 Claims, 4 Drawing Sheets

BAG DISPENSER

I. BACKGROUND OF THE INVENTION

The invention described herein may be manufactured, licensed, and used by or for governmental purposes without the payment of any royalties thereon.

1. Field of the Invention

This invention relates to improved means and methods for dispensing bags, such as plastic, paper, aluminum foil, or aluminum foil laminated with plastic. Specifically, it provides systems for dispensing bags, one at a time, from rolls or from bags stacked in a nested configuration, such that the bags are open after detachment from the dispenser.

2. Prior Art

Bags, such as paper, plastic, aluminum foil, or aluminum foil laminated with plastic, for packaging of small objects or bulk materials, are typically produced in rolls wherein individual bags are detached from adjoining bags by pulling and thereby separating the bags along rows of small perforations. The bottom of one bag is typically adjacent to the top of the next bag in the roll. The edges of the bag openings frequently stick together and the bags often are difficult to open. It is often necessary to print directions on the bags to direct the user to the open end.

Several bag dispensing systems of the prior art seek to overcome the inconvenient features of conventional bag dispensing systems. Typical examples are U.S. Pat. Nos. 4,989,732, 5,183,158, 5,363,965, and 5,863,130, which disclose thermoplastic bag packs wherein bags are stacked side-by-side supported by racks and handle support members. None of these patents disclose the features of the present invention.

II. SUMMARY OF THE INVENTION

The bag dispensing systems of this invention seek to overcome the inconvenience of prior art bag dispensing means. In a first embodiment, closed bags are provided in rolls, connected alternately top-to-top and bottom-to-bottom. Each bag is tapered at the sides toward its bottom such that its top-to-top connection with the next bag is wider than the bottom-to-bottom connection. Each top-to-top connection has a row of small, closely-spaced perforations. The separation of one bag from the next bag moves the sides of the bag in relation to one another, thereby making the bag easier to open. Additionally, the tapered shape of each bag makes it easy to identify the top and bottom of the bag without the need for printed instructions on the bag to identify the top or open end of the bag.

In a second embodiment of this invention, a plurality of tapered open bags is nested, with one bag inside the next. The bags are tapered on both sides such that their bottoms are narrower than their tops. Connected to their tops, there are attachment strips that in turn are connected to each other by conventional means such as staples. Rows of closely-spaced perforations located below the attachment strips ensure that each bag is open when separated by pulling and tearing along the row of perforations. In the nested bag stack used in this embodiment, the tapered bags can be either manufactured with a seam that produces a tapering shape for the bag, or bags with straight parallel sides can be folded in such a way as to produce a tapered shape to the bag.

In a third embodiment of the invention, the tapered bags are first manufactured as tapering tubes with the top and bottom of each tube open. A single plastic tab of a width that fits centrally through the narrower bottom opening of the tapered tubes is perforated transversely at intervals. The perforated plastic tab is inserted through the open bottom seam of each tapered tube. The bottom seam of each bag is sealed and attached to the tab by heat welding at a position on the tab such that the weld and seam are located between two transverse rows of perforations. In manufacturing, successive tapered tubes are slipped on over the outside of the other and each tube is heat-welded to the central plastic tab and the bottom opening is sealed by heat-welding to form a seam in one operation. Thus the bags are nested one within the other with the outer bag sealed and welded to the central plastic tab having alternating seams and perforations. The nested array of bags can be placed in a funnel-like dispenser that holds the bags in a position such that the inner bag is open at the top, ready for articles to be placed inside the bag. The lower end of the central plastic tab emerges from the bottom of the lowest bag and is affixed to the central portion of the funnel-like dispenser by a hook or the like.

In dispensing the bags, after filling the bag, the topmost and innermost bag is removed by grasping the upper edge of the bag and pulling the bag upward. The pulling action breaks the central plastic tab along the row of perforations, which tab extends below the welded seam of the topmost bag. The topmost bag and its contents are then free to be removed from the dispenser. The bag that is below the topmost bag is now open and exposed, ready to receive objects placed in it.

In another embodiment, the central tab is tapered such that the tab is increasingly wider below each successive bag. It is thus possible to assure that the weakest point on the central plastic tab is always immediately below the topmost or innermost tapered bag. When constructed in this way, the nested array of bags will always dispense the topmost or innermost bag when a lifting action is exerted on that bag.

III. BRIEF DESCRIPTION OF DRAWINGS

Figure 2B:
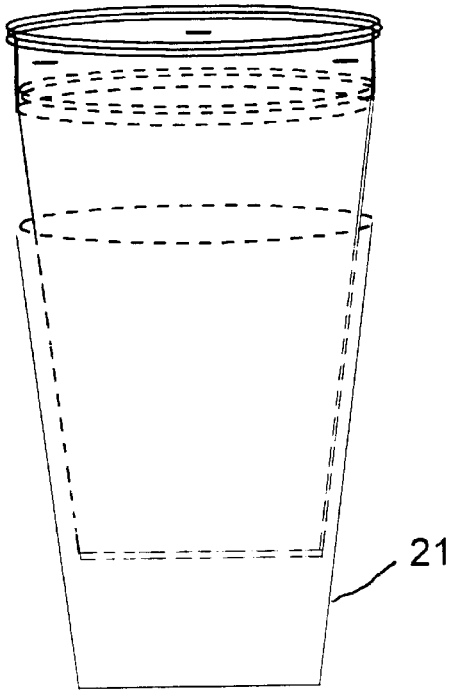
Figure 2A:
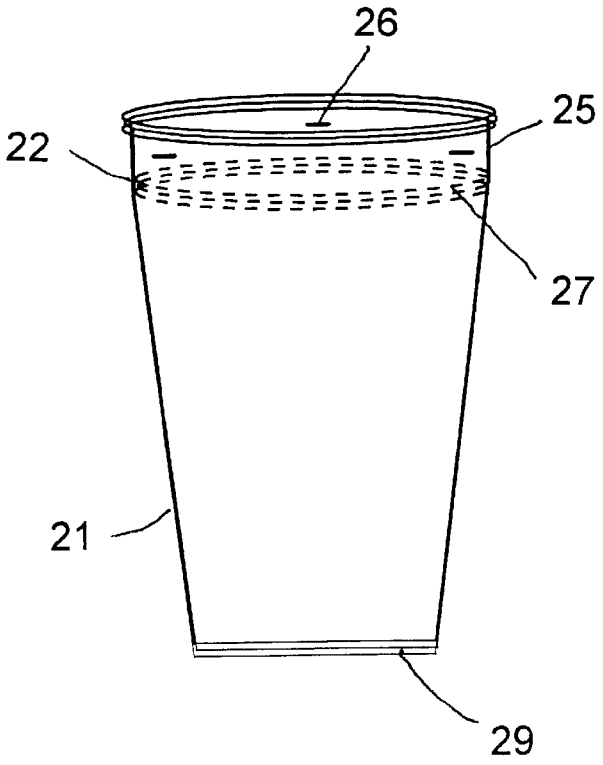
Figure 3:
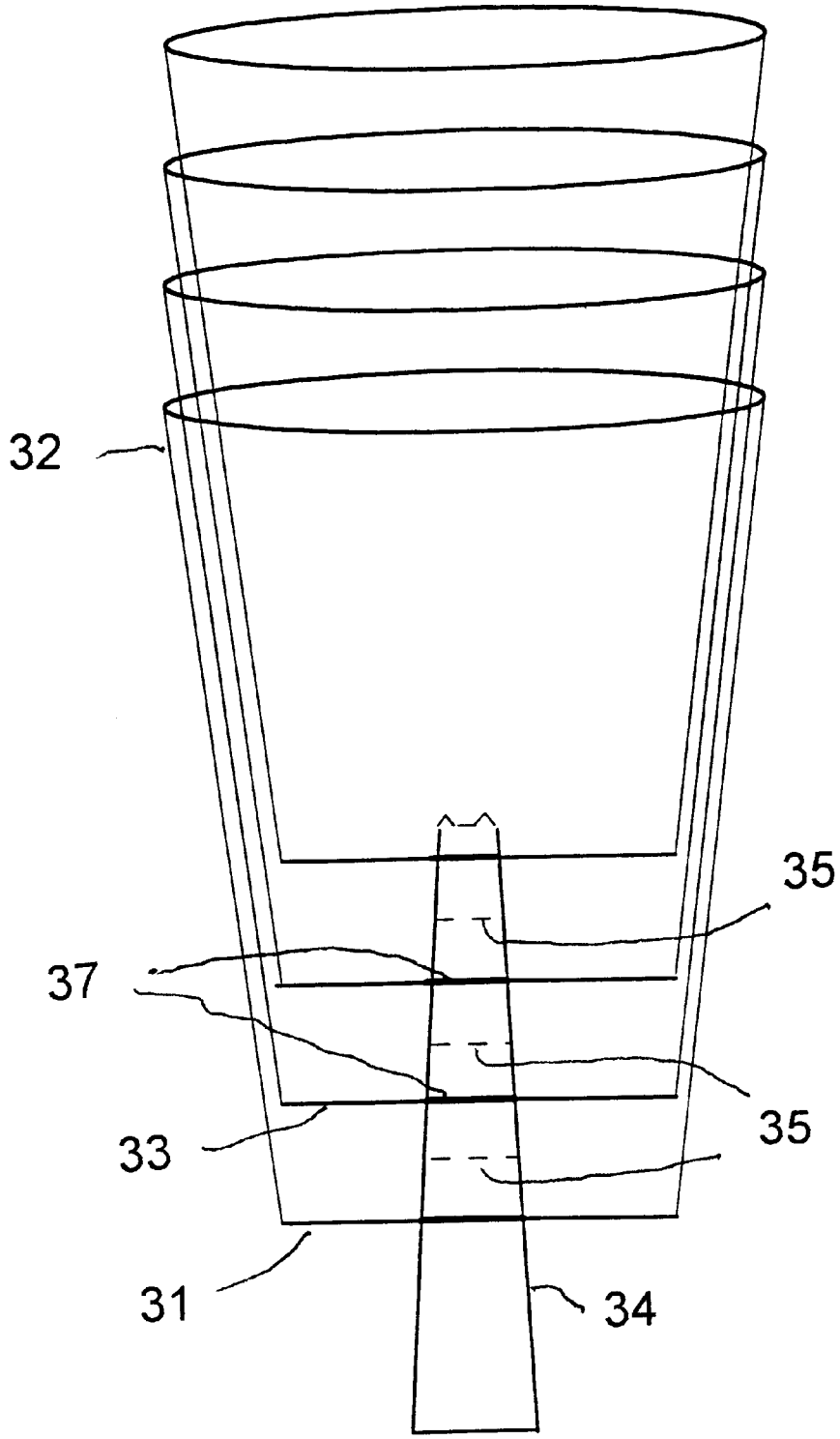
Figure 4:
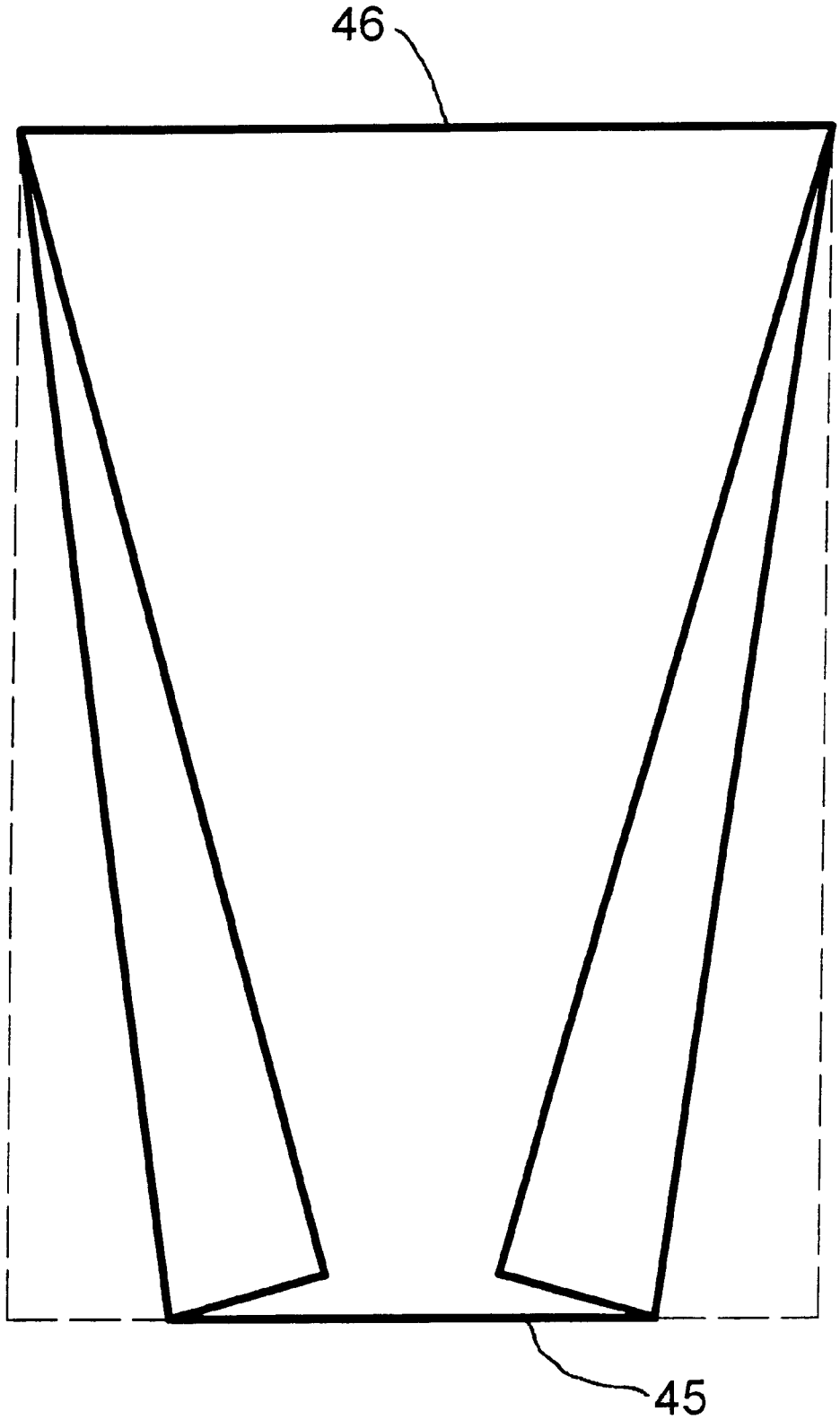

For a further understanding of the nature and operation of the present invention, reference should be had to the accompanying drawings, forming part of this document. FIG. 1. is a frontal view of a strip of tapered bags used to form the roll of bags of the present invention. FIG. 2*a* is a frontal view of a nested array of tapered bags attached along a strip at the open ends of the tapered bags. FIG. 2*b* is a frontal view of a nested array of tapered bags attached along a strip at the open ends of the tapered bags with the outermost bag detached. FIG. 3 is a frontal view of a nested array of tapered bags attached to a tapering, perforated tab that passes through and is welded into the bottom seam of each bag. FIG. 4. is a frontal view of a single parallel-sided bag folded to form a tapered bag.

IV. DETAILED DESCRIPTION OF PREFERRED EMBODIMENTS OF THE INVENTION

The bag dispensers of this invention overcome the inconvenience of prior art bag dispensing means and methods in several ways. In a first embodiment, means are provided for dispensing bags, one at a time, comprising a roll of bags attached to one another along either their tops or bottoms. The top of a first bag is attached to the top of the second next adjacent bag, followed by the bottom of said second bag attached to the bottom of a third next adjacent bag, in a continual alternating fashion forming a roll wherein the width of the top-to-top connection is greater than the width of the bottom-to-bottom connection, and wherein the top connections between adjacent two bags each has a row of closely-spaced perforations, and wherein the bottom connections between two adjacent bags each has a seam closing each bag at its bottom end, and a row of closely-spaced perforations between the seams of adjacent bags, whereby a bag is separated from the roll by pulling and tearing along the row of perforations, having an open top end and a closed bottom end.

In this first embodiment, bags are provided in rolls, connected top-to-top and bottom-to-bottom. The bags are tapered such that the top-to-top connections are wider than the bottom-to-bottom connections. The top-to-top connections have rows of closely-spaced perforations, which ensure that the bag is open when separated from the roll by pulling and tearing along the row of perforations. The bottom-to-bottom connections have sealed seams and a row of perforations between the two sealed seams, which ensure that the bottom seams close the bags after they have been separated from the dispenser. The word tapered shall hereinafter mean the sides are tapered down to the bottom.

With reference to FIG. 1, bags 11 made of plastic foil, paper, aluminum foil, or aluminum foil laminated with plastic, are connected top-to-top, each separated by and along a row of perforations 12, herein referred to as top-to-top connection, The bottom-to-bottom connections between bags each have a sealed seam 14 for closing the bags and a row of perforations 13, which is spaced from and opposed to sealed seams 14. It is clear that the row of perforations 13, is between and parallel to the two adjacent seams 14 for separating the bottom-to-bottom connections between bags. The perforation 13 is referred to as bottom-to-bottom connection. The connected bags 11 are rolled up. Bags are dispensed one-by-one by pulling on the end bag, whereby the closest row of perforations is torn and a single bag is detached. When a top-to-top connection 12 between bags is torn, the bag is open at the free end. When a bottom-to-bottom connection 13 between bags is torn, the free end is closed.

In a second embodiment of this invention, a plurality of tapered bags is nested, with one bag inside the next. The bags are tapered at both sides, such that they are narrower along their bottom edges and wider across their top edges. At their tops, they are each individually attached to strips which are circumferential extensions of the tops and which in turn are attached to each other by conventional means such as staples. Rows of closely-spaced perforations below the strips ensure that each bag is open when separated from the strips by pulling and tearing along the row of perforations.

With reference to FIG. 2*a*, tapered bags 21, each having a top opening 22 and a sealed bottom 29, nested with one bag inside the next, of which the openings 22 are removably attached to strips 25, which in turn are fastened to each other by staples 26. The strips 25 are extensions of bag openings 22 and have sufficient width to enable a stack of strips to be fastened together when assembled. Rows of perforations 27 adjacent to the strips 25, but spaced from the strips 25, allow the removal of one bag at a time by pulling and tearing along the row of perforations 27. The tearing off of the bag by grasping and pulling on the bottoms 29 of the nested bags offers the advantage over the prior-art bag dispensing systems in that the bag dispensed by this invention is open when it is removed and no further action is needed to separate the open edges of the bag. FIG. 2*b* illustrates the array of nested bags with one bag partially removed from the array.

In a third embodiment of this invention, means are provided for dispensing bags, one at a time, comprising a plurality of bags, one nested within a next adjacent bag, and further comprising a central tab passing through said bags and being attached to a bottom seam of said bags, and transverse rows of perforations in the tab between adjacent points of attachment of the bags and the tab, and means for attaching the bags to the tab, and wherein a bag is separated from the tab by pulling and tearing along the row of perforations to provide a bag having an open top end and a closed bottom end.

With reference to FIG. 3, in this third embodiment of the invention, each tapered bag 31 is first manufactured as a tapered tube with the top 32 and bottom 33 of each tube open. A single central tab 34 of plastic, of a width that fits through the bottom 33, is perforated transversely at intervals to form rows of closely-spaced perforations 35 that are parallel to each other. The perforated central tab 34 is inserted through the open bottom 33 of each tapered tube and the bottom 33 is heat welded together to form a bottom seam 36 closing the bottom of the bag. The tab 34 is heat-welded to the bottom 33 of the bag at 37. The perforations 35 on the central tab 34 are located such that the welds at 37 are located between adjacent transverse rows of perforations 35. In this manner successive tapered tubes are slipped on over the outside of the other and each bag is heat-welded to the central tab 34 and the bottom 33 is sealed to form a closed tapered bag. Thus the bags are nested one with the other with the successive outer bag sealed and welded to the central tab.

The nested array of bags may be placed in a funnel-like dispenser (not shown) that holds the nested bags in a upright position such that the innermost bag stands open at the top ready for articles to be placed inside the bag. The lower end of the central plastic strip emerges from the bottom of the lowest bag and is affixed to the central portion of the funnel-like dispenser. After filling the bag, the topmost bag can be removed by grasping the upper edge of the bag and pulling the bag upward. The pulling action breaks the central strip along the row of perforations below the topmost bag. The topmost bag and its contents are then free to be removed from the dispenser. The bag that is below the topmost bag is now open and exposed, ready to receive objects to be placed therein. By tapering the width of the central tab so that the tab is wider below each successive bag, it is possible to assure that the weakest point on the central plastic tab is always immediately below the topmost or innermost tapered bag. When constructed in this way, the nested array of bags will always dispense the topmost or innermost bag when a lifting action is exerted on that bag.

The embodiments of the invention that require that the tapered bags be nested can be used to dispense bags that are manufactured with an initial taper or parallel-sided bags that are folded to form a tapered bag, as shown in FIG. 4. A parallel-sided bag is folded so that the bottom edge 45 is narrower than its top edge 46. Folding the bag permits a conventional parallel-sided bag to be dispensed in a manner similar to a tapered bag.

The nested array discussed in the present invention is designed for use in dispensing bags, but can also be easily adapted to dispense items that are not intended to be used as containers. For example, paper towels and packing materials can similarly be dispensed as nested arrays.

While there have been shown and described what are considered at present to be the preferred embodiments of the present invention, it will be appreciated by those skilled in the art that modification of such embodiments may be made. It is therefore desired that the invention not be limited to these embodiments and it is intended to cover in the appended claims all such modifications as fall within the true spirit and scope of the invention.

What we claim is:

1. Means for dispensing bags, one at a time, comprising a plurality of open bags, each having an open top and a bottom with tapered sides, each nested within a next adjacent bag, and further comprising a central tab passing through the bottoms of said bags and being individually welded to the bottom of each bag forming a seam of said bag, and transverse rows of perforations in the tab between each adjacent welded seams, whereby a bag is separated from the tab by pulling and tearing along the row of perforations to provide a bag having an open top end and a closed bottom.

2. Means of dispensing bags in accordance with claim 1 wherein the bags and tab are made of plastic.

3. Means of dispensing bags in accordance with claim 1 wherein the tab is tapered such that the narrower end is attached to the innermost bag.

* * * * *